United States Patent [19]

Ward et al.

[11] Patent Number: 4,581,613

[45] Date of Patent: Apr. 8, 1986

[54] SUBMERSIBLE PUMP TELEMETRY SYSTEM

[75] Inventors: Donald H. Ward, Glen Ellyn; James R. Tomashek, Wood Dale, both of Ill.

[73] Assignee: Hughes Tool Company, Houston, Tex.

[21] Appl. No.: 376,792

[22] Filed: May 10, 1982

[51] Int. Cl.[4] ..... G01D 3/12

[52] U.S. Cl. ..... 340/856; 166/53

[58] Field of Search ..... 166/53, 64; 340/853, 340/854, 855, 856, 857, 858, 860; 367/76–80, 25; 417/18, 32, 38; 73/151, 152; 175/40, 48

[56] References Cited

U.S. PATENT DOCUMENTS

| | | | |
|---|---|---|---|
| 2,942,112 | 6/1960 | Hearn | 340/857 |
| 3,284,669 | 11/1966 | Boyd | 340/856 |
| 3,340,500 | 9/1967 | Boyd et al. | 340/857 |
| 3,518,623 | 6/1970 | Langford | 340/857 |
| 3,587,076 | 6/1971 | Grover | 340/825.98 |
| 3,810,387 | 5/1974 | Stancliff | 73/151 |
| 4,015,194 | 3/1977 | Epling | 340/859 |
| 4,157,535 | 6/1979 | Balkanli | 340/857 |
| 4,178,579 | 12/1979 | McGibbeny et al. | 340/856 |

*Primary Examiner*—Salvatore Cangialosi
*Assistant Examiner*—K. R. Kaiser
*Attorney, Agent, or Firm*—Robert A. Felsman; James E. Bradley

[57] ABSTRACT

A submersible well pump has a system for monitoring the pressure and temperature in the vicinity of the motor. The system includes a downhole assembly in the well that has a transmitter for generating a signal and superimposing the signal onto the power cable. Transducers in the downhole assembly sense physical parameters such as pressure and temperature and provide electrical responses corresponding to the physical parameters. The transducers are connected to a modulator which modulates the signal provided by the transmitter according to the electrical response of the transducers. The modulated carrier signal is converted at the surface into a readout signal proportional to the physical parameters.

7 Claims, 5 Drawing Figures

NOTE: OV INDICATES THE ZERO VOLTAGE REFERENCE LEVEL

SUBMERSIBLE PUMP TELEMETRY SYSTEM

BACKGROUND OF THE INVENTION

This invention relates in general to submersible pumps and in particular to a system for monitoring at the surface the pressure and temperature in the pump motor environment.

The submersible pump installations concerned herein include a large electric motor located in the well. The electric motor receives three-phase power over a power cable from the surface with voltages phase-to-phase being commonly 480 volts or more. The electric motor drives a centrifugal pump to pump well fluid to the surface.

It is important to be continuously aware at the surface of the downhole operating conditions. The pressure of the lubricant in the motor is the same as the well fluid pressure, and provides an indication of whether or not the pump is operating efficiently. Temperature also provides an indication of whether or not the motor is overheating, which might possibly cause early failure. U.S. Pat. No. 3,340,500 issued to C. A. Boyd et al discloses a system for monitoring pressure using the power cables as a linkage between downhole sensors and uphole receiving units. The Boyd patent superimposes a DC level on the AC power conductors, with changes in the DC level being proportional to the physical parameter sensed. There are other later patents that also utilize the principle of passing DC current over AC lines and through a sensor to provide a resistance change that is indicated at the surface.

Improvements are desirable because of the extreme conditions in the well. A pump and any downhole sensing and measuring equipment normally remains in the well for a year and a half or more before being pulled to the surface for maintenance. The temperature is often 200° F. and higher. The voltage and current being supplied to the motor are also at high levels.

SUMMARY OF THE INVENTION

In this invention, a downhole assembly is located in the well in the vicinity of the motor. The downhole assembly includes a transmitter for generating a signal and for superimposing the signal on the power cable. The downhole unit also has sensing means that provides an electrical response or characteristic proportional to a physical parameter in the vicinity of the well. A modulating portion of the downhole unit modulates the signal being sent uphole in proportion to the sensing means. At the surface unit, a conversion circuit detects the modulated signal and converts it into a readout signal proportional to the physical parameter being sensed downhole.

DESCRIPTION OF THE PREFERRED EMBODIMENT

Figure 1:
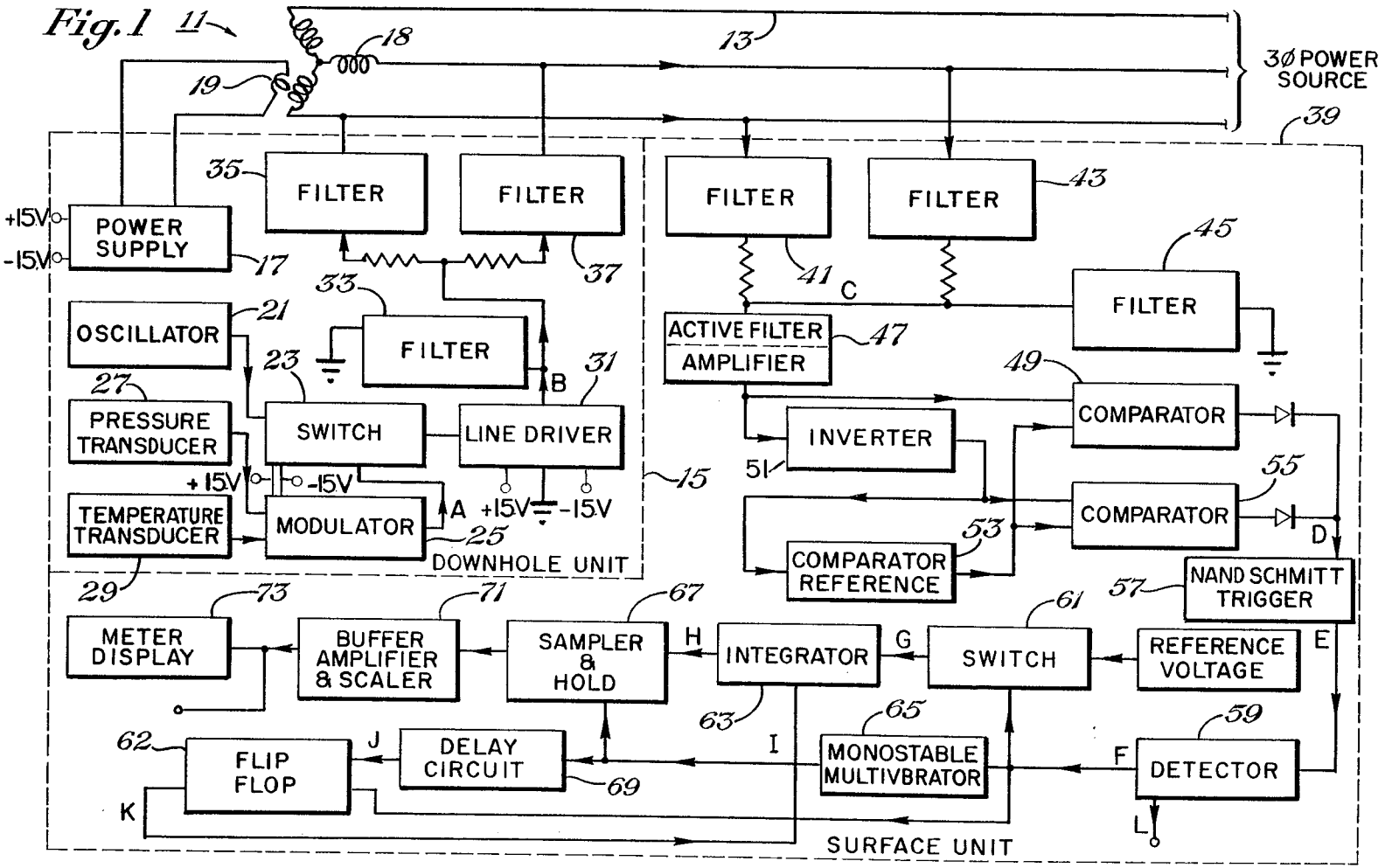
FIG. 1 is a block diagram of a telemetry system constructed in accordance with this invention.

Referring to the block diagram of FIG. 1, a pump motor 11 is connected to a three-phase power source by means of three power cables 13. The measuring means for measuring pressure and temperature at the motor 11 includes a downhole unit 15 that is located normally at the bottom of the motor and in communication with the lubricating oil contained in the motor. Through pressure compensators, the lubricating oil will be at about the same pressure as the pressure of the well fluid.

Downhole unit or assembly 15 includes a power supply 17 that supplies a regulated DC level. The power supply receives AC power through inductive coupling means from the windings 18 in motor 11. Windings 18 are the normal windings of the stator (not shown) of the motor. In the preferred embodiment, the inductive coupling means comprises a loop of wire or winding 19 that is looped through the stator slots the entire length of the stator and connected to the power supply 17. Winding 19 serves as the secondary of a transformer to receive AC power through induction from the windings 18. This avoids the need for physically tapping for power onto the power cables 13 or windings 18 of the motor 11.

Power supply 17 supplies DC power to the components of the downhole unit, these components including an oscillator 21. Oscillator 21 supplies a 10 KHZ (10,000 cycles per second) carrier signal, which is much higher than the normal power frequency of about 60 cycles per second. A switch 23 receives the carrier signal from oscillator 21 and selectively blocks and allows the carrier signal to pass. Switch 23 is controlled by a modulator circuit 25. The modulator circuit 25 is connected to a pressure transducer 27 and a temperature transducer 29. The transducers 27 and 29 serve as means for providing electrical changes that correspond to a physical parameter of the motor environment. In the preferred embodiment, the transducers 27 and 29 are of the type that provide a variable resistance corresponding to the temperature and pressure.

The modulator 25 directs current through the pressure transducer for a time interval that depends upon the pressure. It then switches to direct current through the temperature transducer for a time interval that depends upon the temperature. When the pressure transducer 27 is active, the modulator 25 will provide an output or pulse to switch 23, which in the preferred embodiment is an enabling output. When the temperature transducer 29 is active, the modulator 25 will provide a disabling output to switch 23. Switch 23 thus allows a signal to pass at the carrier frequency for a duration depending upon the pressure. Switch 23 blocks the carrier frequency for a duration depending upon the temperature.

Switch 23 is connected to a line driver 31 for applying the modulated carrier frequency to two of the power cables 13. Filters 33, 35 and 37 allow the modulated carrier frequency to pass onto the lines, but block the three-phase power frequency from the measuring components of the downhole unit 15. All of the filters are resonant at the carrier frequency. Filter 33 is parallel resonant to shunt the power frequency, but not the carrier frequency. Filters 35 and 37 are series resonant to provide a low impedance to the carrier frequency and a high impedance to other frequencies.

Figure 2:
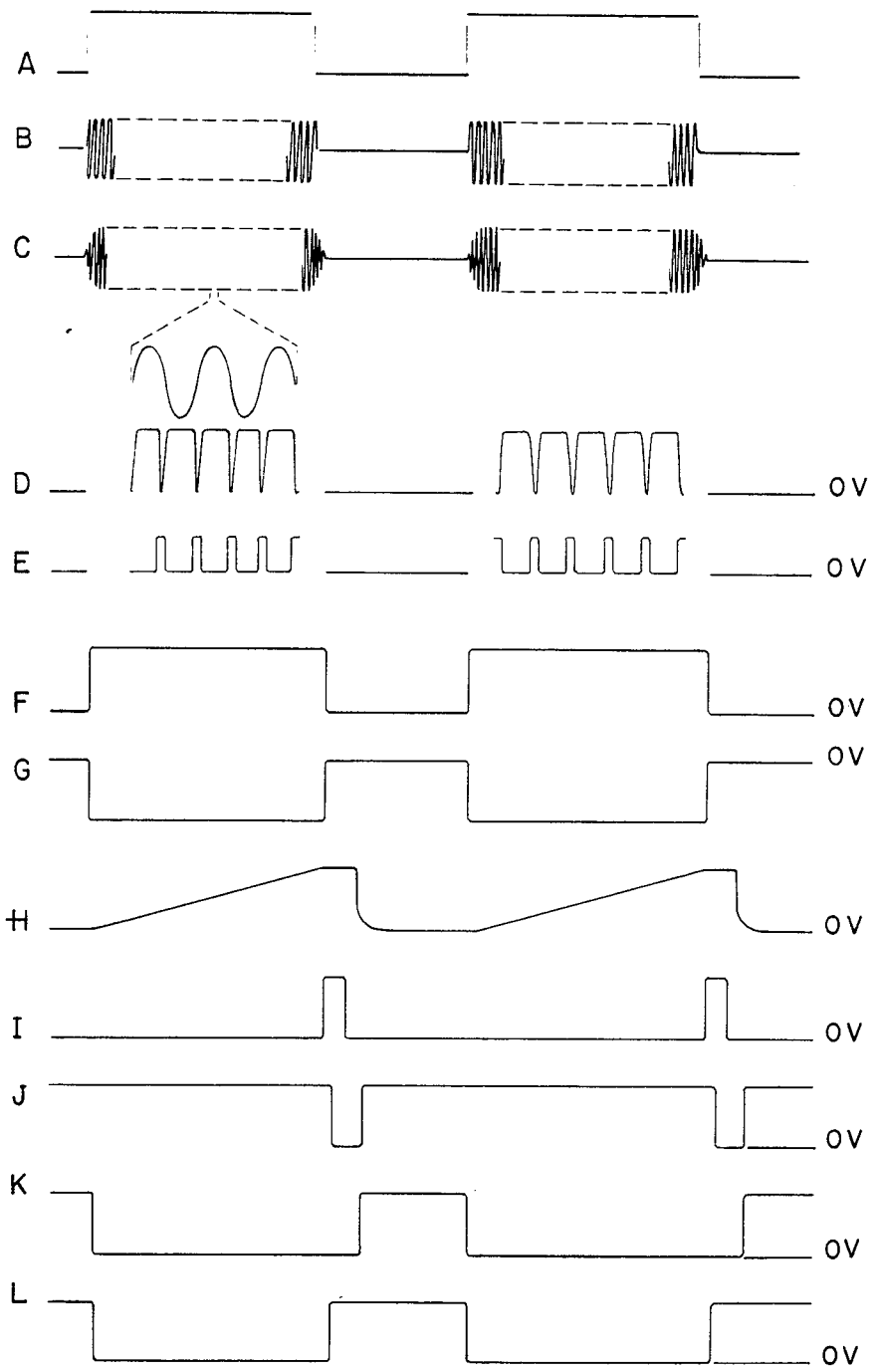
FIG. 2 is a series of waveforms at various points in the block diagram.

Referring to FIG. 2, the waveform A (point A in FIG. 1) comprises controlling pulses at the output of the modulator 25 and the input of the switch 23. Waveform B of FIG. 2 shows the modulated carrier signal at point B in FIG. 1, which is the output of line driver 31. The duration of the signal of carrier frequency corresponds to the pressure. In the preferred embodiment, the time interval between the active portions is proportional to the reciprocal of the temperature being sensed.

At the surface unit 39, taps are connected to two of the cables 13 for receiving the modulated carrier signal. Series resonant filters 41 and 43 pass the carrier frequency and block other frequencies. Filter 45 shunts other frequencies and blocks the carrier frequency, it being a parallel resonant filter. An active filter and amplifier 47 provides a better signal to noise ratio. The waveform C (FIG. 2) at point C in FIG. 1 shows the carrier frequency and shows by the expanded portion that it is sinusoidal.

The modulated carrier frequency signal is applied to a comparator 49. The signal is also applied to an inverter 51 and a comparator reference circuit 53. The inverted signal is in turn applied to a second comparator 55, identical to comparator 49. Comparators 49 and 55 provide a rectified waveform D, as shown in FIG. 2. There is a time constant within the system which results in a certain buildup time and tail off of the modulated carrier frequency received at the surface. The comparator reference circuit 53 functions to set the switching level of the comparators 49 and 55 approximately at the midpoint amplitude of the signal. This minimizes timing error associated with the buildup and decay time of the signal. The two comparators double the effective time resolution of the system.

The combined output of the comparators 49 and 55 is applied to a NAND Schmitt trigger 57, which provides pulses at point E as shown by waveform E in FIG. 2. The pulses are applied to a retriggerable monostable multivibrator which functions as an envelope detector 59. The time constant of the envelope detector 59 is slightly longer than one-half the period of one cycle of the carrier frequency. A high output of envelope detector 59 switches by means of the switch 61 a fixed voltage to integrator 63. The output F of the envelope detector 59 is shown as waveform F in FIG. 2. Envelope detector 59 also sets a flip-flop 62, which is connected to integrator 63. The switch 61 output G is shown as waveform G in FIG. 2. The integrator output H provides a ramp as shown by the waveform H in FIG. 2. The flip-flop 62 output K is shown by the waveform K in FIG. 2.

When the output of envelope detector 59 goes low, integrator 63 terminates and a monostable multivibrator 65 is activated. The output I from the monostable multivibrator 65 enables a sample and hold circuit 67 to read the peak value of the ramp voltage from integrator 63. The output I is shown as waveform I in FIG. 2. The output of monostable multivibrator 65 through a delay circuit 69 also resets flip-flop 62 after the integrator 63 output has been sampled. A high output level of flip-flop 62 places the integrator 63 in a reset condition in preparation for the next cycle. The integrator 63 peak output is proportional to the period of the active portion of the modulated carrier signal. The voltage from the sample and hold circuit 67 is applied to a buffer amplifier and scaler 71. This output, which is displayed on a panel meter 73, is available as a control or monitor signal.

The envelope detector 59 also has an output L which is shown in FIG. 2. This output is applied to a second channel for providing a temperature readout corresponding to the duration between envelopes. The temperature channel has essentially identical circuits to those of the pressure channel. These circuits include the bilateral switch 61, flip flop 62, integrator 63, monostable multivibrator 65, sample and hold circuit 67, buffer amplifier and scaler 71, meter display 73, and delay circuit 69. The scaling circuits are slightly different since the temperature signal is a reciprocal function.

Figure 3:
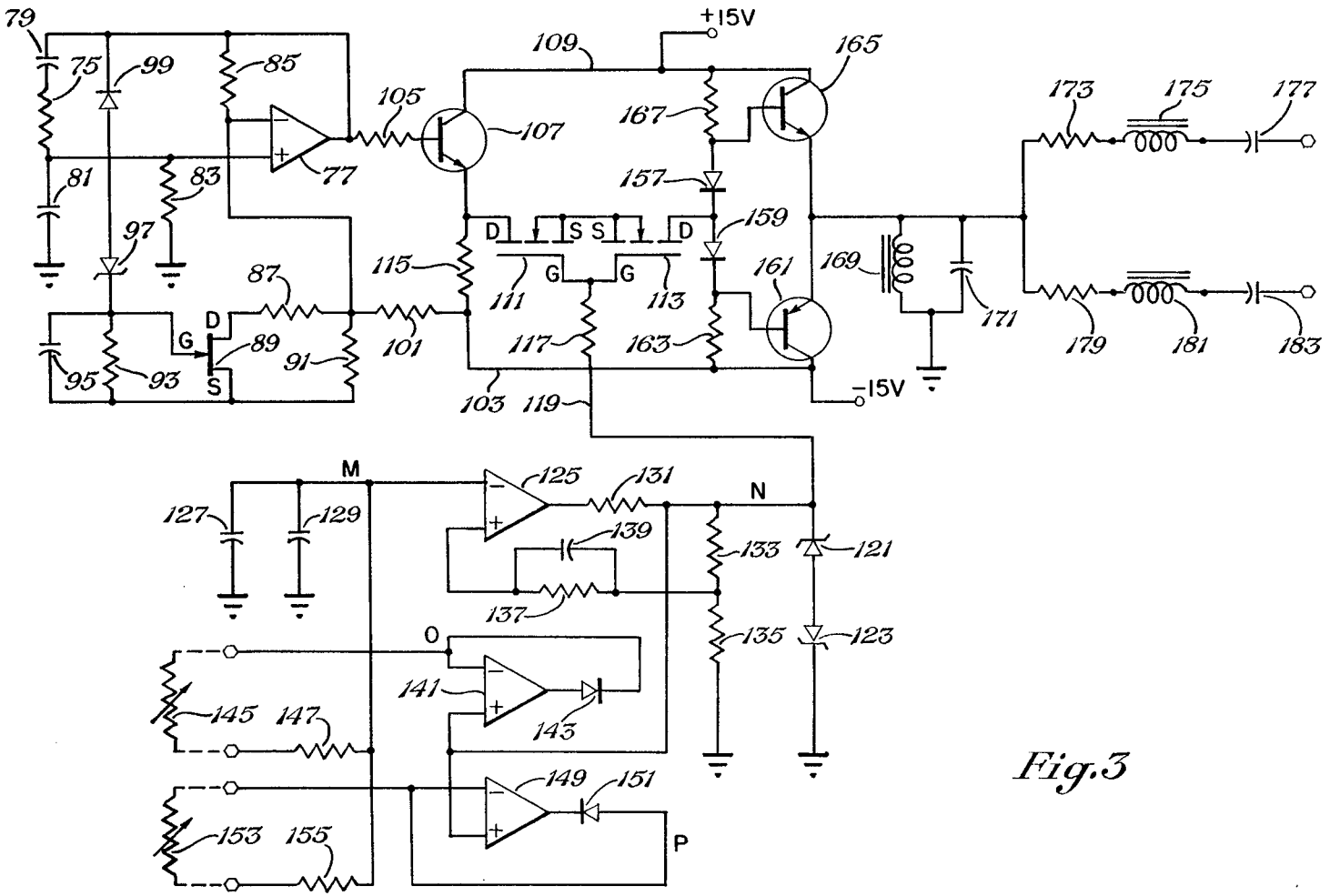
FIG. 3 is a circuit diagram of part of the downhole assembly of this invention.

The electrical schematic for the downhole assembly 15 is shown in FIG. 3, except for the power supply 17 (FIG. 1), which may be of various types so long as it is capable of handling a wide range of AC inputs and fairly high temperatures and provides the regulated output voltages. The oscillator 21 (FIG. 1) portion of the downhole assembly is of a conventional nature and includes a resistor 75 that is connected to the positive input of an operational amplifier 77. A capacitor 79 is connected between resistor 75 and the output of amplifier 77. A capacitor 81 is connected between the positive input of amplifier 77 and ground. A resistor 83 is connected between the positive input of amplifier 77 and ground. A resistor 85 is connected between the negative input and the output of amplifier 77. A resistor 87 is connected between the negative input of amplifier 77 and the drain of a FET transistor 89. A resistor 91 is connected between the negative input of amplifier 77 and the source of transistor 89. A resistor 93 is connected between the gate and source of transistor 89. A capacitor 95 is connected in parallel with resistor 93. A 7.5 volt Zener diode 97 is connected between resistor 93 and the anode of diode 99. The cathode of diode 99 is connected to the output of amplifier 77.

The oscillator amplifier as well as the other operational amplifiers are powered by a negative 15 volt source and a positive 15 volt source (not shown). Resistor 101 provides a bias voltage to the amplifier. The oscillator operates in a conventional manner to deliver a 10 KHZ signal to a buffer transistor 107 through a resistor 105. The collector of buffer transistor 107 is connected to line 109, which is supplied with a positive 15 volt potential. The emitter of transistor 107 is connected to a switching means for switching on and off the carrier frequency being provided from the emitter of transistor 107. This switching means includes two FET transistors 111 and 113. Further circuitry in the switching means includes a resistor 115 connected between the drain of transistor 111 and line 103. The gates of transistors 111 and 113 are each connected to a resistor 117, which in turn is connected to a line 119. A positive input on line 119 will allow both transistors 111 and 113 to conduct. One of the transistors, 113, blocks the signal during the negative half of the carrier frequency while the other transistor blocks the signal during the positive half of the frequency. A negative potential on line 119 causes transistors 111 and 113 to block the carrier signal.

Line 119 is connected through oppositely facing Zener diodes 121 and 123 to ground. The modulating portion of the circuit for modulating the carrier signal includes a differential amplifier 125. Differential amplifier 125 is part of the means for varying the potential on line 119 to control the transistors 111 and 113. A pair of capacitors 127 and 129 are connected in parallel from ground to the negative input of amplifier 125. The output of amplifier 125 is connected through a resistor 131 to line 119. A voltage dividing network including resistors 133 and 135 is connected between line 119 and ground. Resistors 133 and 135 provide approximately half the voltage on line 119 to a resistor 137, which is connected between the junction of resistors 133 and 135 and the positive input of amplifier 125. A capacitor 139 is connected in parallel with resistor 137.

An operational amplifier 141 has its negative input connected to the cathode of a diode 143. The anode is connected to the output of amplifier 141. The negative input of amplifier 141 is also connected to a pressure transducer 145. Pressure transducer 145 is a variable resistance type, with the resistance increasing with pressure. Pressure transducer 145 serves as sensing means for providing an electrical change corresponding to a physical parameter in the vicinity of the electrical motor. Transducer 145 is connected to the negative input of amplifier 125 through a resistor 147.

An amplifier 149 has its output connected to the cathode of a diode 151. The anode of diode 151 is connected to the negative input of amplifier 149. The negative input of amplifier 149 is also connected to a temperature transducer 153. Temperature transducer 153 is of a variable resistance type that provides an increase in resistance with a decrease in temperature. Transducer 153 also serves as sensing means for sensing a physical parameter in the environment of the electrical motor and providing an electrical response thereto. The other side of transducer 153 is connected to a resistor 155, which is connected to the negative input of amplifier 125. The positive input of amplifier 149 is connected to the positive input of amplifier 141, these inputs also being connected to line 119.

In the operation of the modulator, amplifier 125 will provide a positive output when the positive input is greater than the negative input. The positive output enables the transistors 111 and 113 to allow the carrier frequency to pass. When the positive input to amplifier 125 is greater than the negative input, the positive output will be applied to the positive input of amplifier 141. Amplifier 141 will thus provide a positive output, which passes through diode 143, pressure transducer 145, and resistor 147 to capacitors 127 and 129. Capacitors 127 and 129 will store energy, causing an increase in voltage at the negative input of amplifier 125, as shown by waveform M in FIG. 4 of amplifier 125. The negative input O of amplifier 141 (waveform O in FIG. 4) is at the positive value of the zener voltage when current is flowing through pressure transducer 145.

Figure 4:
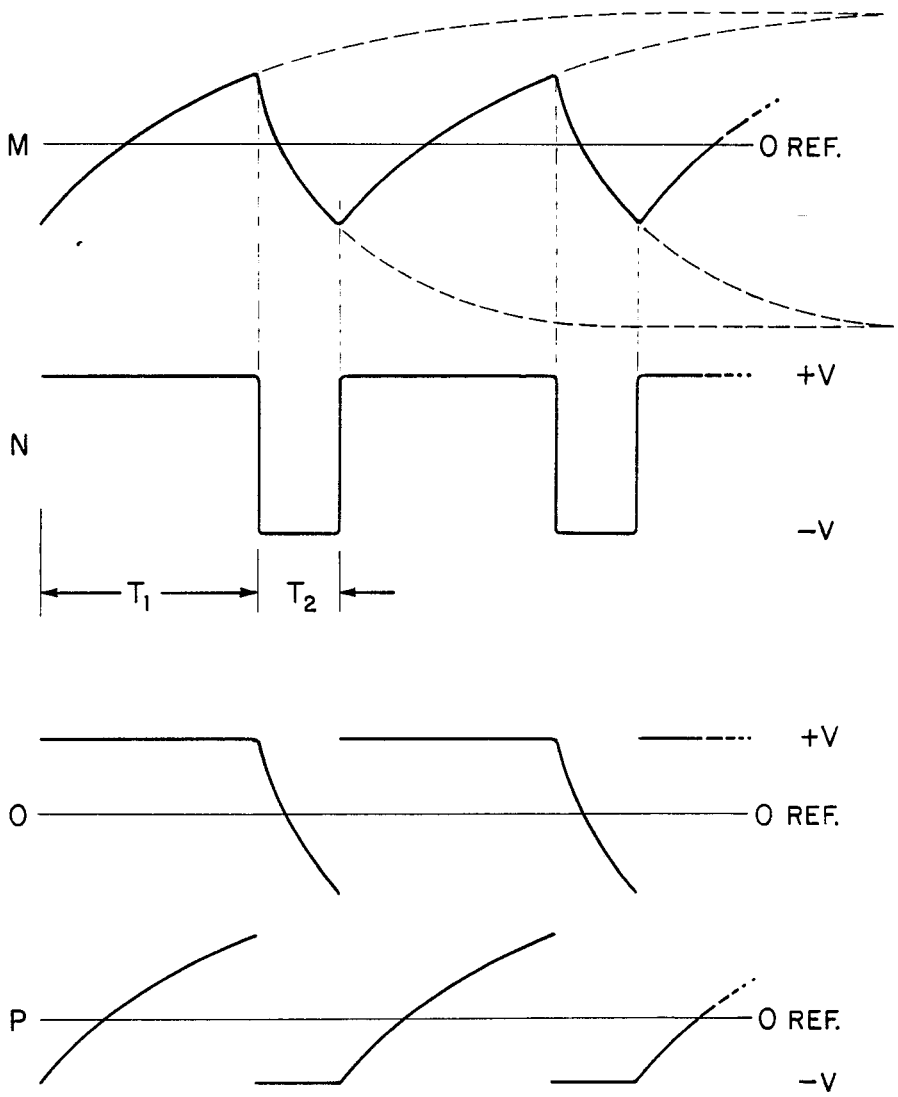
FIG. 4 is a series of waveforms at various points in the circuit diagram of FIG. 3.

No current will be flowing through temperature transducer 153 while pressure transducer 145 is receiving current. The reason is that the positive voltage on line 119 will be applied to the positive input of amplifier 149, resulting in a positive output. The positive output is blocked by the diode 151, preventing current from flowing through temperature transducer 153. When capacitors 127 and 129 charge to a certain level, the negative input of amplifier 125 will equal that of the positive input, thus causing amplifier 125 output to switch to a low or negative value as shown by waveform N in FIG. 2. The negative output will be applied to the positive inputs of the amplifiers 141 and 149. This results in negative outputs on both amplifiers 141 and 149, however, the diode 143 will block current flow, preventing any current from flowing through the pressure transducer 145. Diode 151 will allow current to flow through the temperature transducer 153, thus allowing the capacitors 127 and 129 to discharge. Waveform P in FIG. 4 shows the waveform at the anode of diode 151. Waveform M shows the resulting waveform at the negative input of amplifier 125. When the capacitors 127 and 129 have discharged sufficiently the negative input to amplifier 125 will again drop below the positive input, causing a positive output of amplifier 125 and thus repeating the cycle. The time $T_1$ (waveform N) for the capacitors 127 and 129 to charge depends on the resistance of pressure transducer 145, while the time $T_2$ for the capacitors 127 and 129 to discharge depends on the resistance of temperature transducer 153. The diodes 143 and 151 and the amplifiers 151 and 149 serve as directing means for directing current through one of the transducer means 145 or 153 until the capacitors 127 and 129 charge to a selected level, then for directing the current through the other of the transducer means until the capacitors discharge to a selected level.

Referring still to FIG. 3, the line driver 31 (FIG. 1) comprises a standard complimentary push-pull amplifier. The amplifier includes diodes 157 and 159, the junction of which is connected to the drain of transistor 113. The base of a PNP transistor 161 is connected to the cathode of diode 159. A resistor 163 is connected between the collector and base of transistor 161. The collector of transistor 161 is also connected to line 103, which has a negative 15 volt potential. A NPN transistor 165 has its base connected to the anode of diode 157. A resistor 167 is connected between the collector and base of transistor 165. The collector of transistor 165 is connected to line 109, which has a positive 15 volt potential. The emitters of transistors 161 and 165 are connected together, with the output leading to a filter 33 (FIG. 1).

Filter 33 (FIG. 1) comprises an inductor 169 and capacitor 171 connected in parallel and to ground. Inductor 169 and capacitor 171 are sized to resonate at the carrier frequency. This shunts any other frequencies to ground, such as any power frequencies from the power cables 13 (FIG. 1). Two filters 35 and 37 (FIG. 1) are connected to the emitters of transistor 161 and 165 and to the power cables 13 (FIG. 1) through resistors 173 and 179. One of the filters comprises inductor 175 and capacitor 177 in series. Inductor 181 and capacitor 183 are in series and comprise the other filter. The inductors and capacitors of these filters are dimensioned to resonate at carrier frequency, allowing the carrier frequency to pass, but blocking other frequencies such as the power frequency. The resistors 173 and 179 prevent a short circuit to ground on either of lines 13 from shorting out the line driver output signal.

Figure 5:
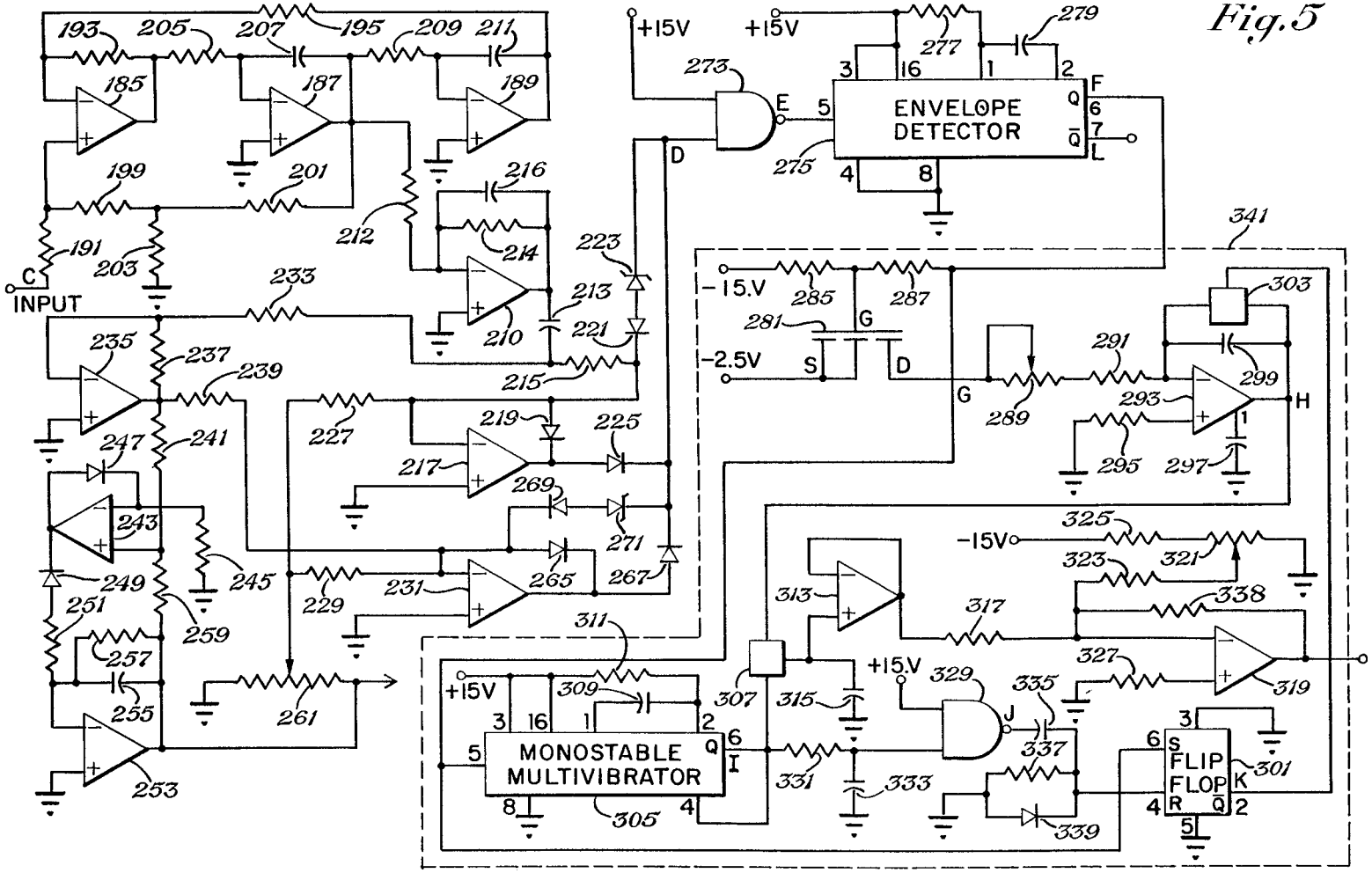
FIG. 5 is circuit diagram of part of the surface equipment of this invention.

FIG. 5 shows the electrical schematic of the surface equipment, which serves as conversion means for converting the modulated signal into a readout signal proportional to the temperature and pressure. Filters 41, 43 and 45 (FIG. 1), are not shown in FIG. 5, but are the same type as the filters 35, 37 and 33 (FIG. 1) respectively. Waveform C (FIG. 2) is applied to an active filter amplifier 47 (FIG. 1) which comprises amplifiers 185, 187 and 189. These operational amplifiers are connected conventionally to improve the signal to noise ratio. Amplifier 185 has its positive input connected to a resistor 191, which receives the modulated carrier wave.

A resistor 193 is connected between the negative input and the output of amplifier 185. A resistor 195 is connected between the negative input of amplifier 185 and the output of amplifier 189. A resistor 199 is connected between the positive input of amplifier 185 and a resistor 201. A resistor 203 is connected between ground and the junction between resistors 199 and 201. A resistor 205 is connected between the output of amplifier 185 and the negative input of amplifier 187. A capacitor 207 is connected between the negative input and the output of amplifier 187. A resistor 209 is connected between the output of amplifier 187 and the negative input of amplifier 189. A capacitor 211 is connected between the negative input and the output of amplifier 189. A capacitor 213 is connected to the output of amplifier 210 and a resistor 215.

The output of amplifier 187 passes through resistor 212 to an amplifier 210 which has a gain of about 10 at the carrier frequency. A resistor 214 and capacitor 216 are connected in parallel between the input and output of amplifier 210. The output of amplifier 210 passes through a capacitor 213 and a resistor 215 to a first amplifier or comparator 217. A diode 219 is connected between the negative input and the output of comparator 217. A diode 221 has its cathode connected to resistor 215 and the anode of diode 219. A Zener diode 223 has its anode connected to the anode of diode 221. Another diode 225 has its anode connected to the output of comparator 217. A second comparator 231 has diodes 265, 267, 269 and a zener diode 271 connected in a similar manner as the first comparator 217.

The output of amplifier 210 is also connected to the negative input of an inverting amplifier 235 through a resistor 233. A resistor 237 is connected between the negative input and the output of inverter 235. A resistor 239 is connected between the output of inverter 235 and the negative input of a second comparator 231. A resistor 241 is connected between the output of inverter 235 and an amplifier 243, which serves as part of the comparator reference circuit 53 (FIG. 1). The negative input of amplifier 243 is connected to ground through a resistor 245. A diode 247 is connected between the negative input and the output of amplifier 243. A diode 249 has its cathode connected to amplifier 243 and its anode connected to a resistor 251. Resistor 251 is connected to an amplifier 253. A capacitor 255 is connected between the negative input and the output of amplifier 253. A resistor 257 is connected in parallel with capacitor 255. A resistor 259 connects the output of amplifier 253 to the positive input of amplifier 243. The output of amplifier 253 is also connected to a potentiometer 261, which in turn is connected to ground. The wiper of potentiometer 261 is connected to the resistors 227 and 229, which in turn are connected to the comparators 217 and 231.

In the operation of the comparators 217 and 231, the modulated carrier signal is applied to comparators 217 and 231. Comparator 231 allows the positive half of the carrier signal to pass because it was inverted by amplifier 235, while comparator 217 allows the negative half of the signal to pass. At the same time, the comparator reference circuit 53 (FIG. 1) sets the switching level of the comparators at approximately the midpoint amplitude of the carrier signal. This results in the waveform D (FIG. 2). The comparator reference circuit accomplishes this by receiving the carrier signal at inverter 235, and passing it to the operational amplifiers 243 and 253. Amplifier 243 functions as a rectifier. Diode 249 will allow only the negative half of the carrier signal to pass to the input of amplifier 253. Amplifier 253 operates with capacitor 255 and associated resistors to provide peak signal averaging. The output to potentiometer 261 depends upon the peak amplitude of the carrier signal. The potential on the wiper of potentiometer 261 adds to the carrier signal being received at the inputs of the comparators 217 and 231, setting their switching level. The potentiometer 261 is adjusted so that the comparators 217 and 231 will always trigger at about the midpoint of the amplitude of the carrier signal, regardless of the amplitude. This avoids errors due to the time build up and tail off in the modulated carrier signal.

The combined output from the comparators 217 and 231 is applied to a Schmitt trigger 273. Schmitt trigger 273 is connected to a positive 15 volt source and provides a series of pulses as shown by waveform E (FIG. 2). These pulses trigger an integrated circuit 275 that is a retriggerable monostable multivibrator, which functions as an envelope detector. Envelope detector 275 provides a waveform F (FIG. 2) at pin 6 that is equal to the duration of the envelope. Waveform F is used to provide a readout of pressure. An inverted waveform L (FIG. 2) at pin 7 is used to provide a readout of temperature through substantially identical circuitry (not shown). Envelope detector 275 has a resistor 277 connected between pin 16 and pin 1. Pin 16 is in contact with a positive 15 volt potential. A capacitor 279 is connected between pins 1 and 2. Envelope detector 275 is a conventional circuit available as CD4098BE.

The waveform at pin 6 of envelope detector 275 is applied to the gate of a FET transistor 281. Transistor 281 serves as the switch 61 (FIG. 1) to allow current flow to the negative 2.5 volt source. The gate of transistor 281 is connected to a −15. volt source through a resistor 285. A resistor 287 is connected between the gate and pin 6 of envelope detector 275. Transistor 281 is turned on during the on duration of the envelope by pin 6 of envelope detector 275, as indicated by waveform F in FIG. 2. A potentiometer 289 allows adjustment of the span or full scale range of the pressure signal. The potentiometer 289 is connected to a resistor 291, which in turn is connected to the negative input of an integrator 293.

Integrator 293 provides a voltage ramp while the transistor 281 is on, as shown by waveform H in FIG. 2. Associated circuitry with the integrator includes a resistor 295 connected between the positive input and ground and a capacitor 297 connected to pin 1 and ground. Integrator 293 is a conventional integrated circuit, CA3140E. A capacitor 299 is connected between the negative input and the output of integrator 293. The voltage ramp is the charge build up on capacitor 299 as current flows through the capacitor, resistors 291 and 289 and the switch 281.

At the same time that pin 6 of envelope detector 275 goes high at the beginning of the envelope, a flip-flop 301 (flip flop 62 in FIG. 1) is set. Flip-flop 301 is connected to pin 6 of detector 275 by means of its pin 6. Flip-flop 301 is a conventional integrated circuit identified by CD4013BE. Flip-flop 301, when set by the high output of envelope detector 275, provides a low output on pin 2 that opens a CMOS switch 303. Waveform K in FIG. 2 shows the output from flip-flop 301. When switch 303 is open, integrator 293 is allowed to continue ramping. When flip-flop 301 provides a high output to close switch 303, the capacitor 299 discharges to prevent ramping. Switch 303 is a conventional switch identified by CD4016BE.

The envelope waveform F at pin 6 of envelope detector 275 also triggers a monostable multivibrator 305. Multivibrator 305 is an integrated circuit that corresponds to multivibrator 65 shown on the block diagram of FIG. 1. It may be a CD 4098BE. Multivibrator 305 provides a high on its pin 6 when its pin 5 goes low at the end of the envelope. A high output at pin 6 of multivibrator 305 closes a CMOS bilateral switch 307. Normally the switch 307 will be open, blocking the ramp output of integrator 293. Associated circuitry with multivibrator 305 include a capacitor 309 connected between pins 1 and 2 and a resistor 311 connected between pins 2 and 16.

The closing of switch 307 connects the integrator 293 output to the capacitor 315 and also to the sample and hold amplifier 313. Amplifier 313 is a voltage follower amplifier having its positive input connected through capacitor 315 to ground. When switch 307 conducts, the output of integrator 293 charges capacitor 315 to the value of the ramp voltage at the instant switch 281 opens. This peak value is applied to amplifier 313. Amplifier 313, switch 307 and capacitor 315 comprise the sample and hold circuit 67 of FIG. 1. The peak value held by amplifier 313 is applied through a resistor 317 to a buffer amplifier 319. Buffer amplifier 319 is connected to scaling circuitry, which includes a potentiometer 321 connected to a 15 volt supply and resistors 323 and 325. The output of amplifier 319 is applied to a digital voltmeter (not shown). The positive input to amplifier 319 is connected to ground through resistor 327. Resistor 338 connects the output of amplifier 319 to its negative input. Potentiometer 321 is a means of adjusting the zero or minimum signal level of this data channel.

When the pulse waveform (I of FIG. 2) of the monostable multivibrator 305 goes low again, switch 307 opens. Capacitor 315 will maintain the peak value of the ramp at the input to amplifier 313. The pulse waveform I from the monostable multivibrator also is applied to a Schmitt trigger 329 through a resistor 331. Schmitt trigger 329 serves as part of a delay circuit 69 (FIG. 1). A capacitor 333 is connected to the input of Schmitt trigger 329. The output of Schmitt trigger 329 is applied through a capacitor 335, resistor 337 and diode 339 to pin 4 of the flip-flop 301. This resets the flip-flop after the integrator 293 output has been sampled by the amplifier 313. Flip-flop 301, as shown by waveform K, closes switch 303 which discharges capacitor 299. This resets the integrator output to zero to allow integrator 293 to begin a ramp voltage from zero level at the occurrence of the next envelope. A high level of flip-flop 301 output at pin 2 maintains the integrator 293 in a reset condition in preparation for the next cycle.

The circuitry contained within the dotted lines 341 is duplicated for the readout of the temperature being sensed. The inverse of the temperature is proportional to the duration between envelopes. There will be some differences in scaling, such as in resistors 321, 323, and 325, but otherwise identical components are used. The input to the temperature circuitry is through pin 7 of envelope detector 275.

In addition to the circuitry shown in FIG. 5, a blanking circuit (not shown) is used to blank out the meter display if the amplitude of the carrier signal being received at the surface is below a minimum amount. This blanking circuit may be of various types, and in general is a circuit that senses the carrier signal amplitude, such as at potentiometer 261, compares it to a preset value, and if below, applies it to a delay circuitry. If the duration of the below minimum signal is sufficient, the delay circuitry will send a signal to blank out the meter display to avoid possibly erroneous readings. Spurious drops in amplitude with durations less than the delay minimum will not blank out the meter display.

The invention has significant advantages. Temperature and pressure are accurately sensed and monitored at the surface. The system does not require DC to be superimposed onto the power cables, as in the prior art. Accurate information can be transmitted to the surface even if one phase of the power cables is grounded. Leakage in power cable insulation will not affect the accuracy of the readings. More than two physical parameters can be measured, although not shown, by the use of different carrier frequencies for different parameters. The insulation of the power cables can be tested under high voltage conditions without being influenced by the downhole pressure and temperature transducers. All of the components of the system are conventional and available commercially.

While the invention has been shown in only one of its forms, it should be apparent to those skilled in the art that it is not so limited but is susceptible to various changes and modifications without departing from the scope of the invention

We claim:

1. In a pump installation having a power cable for delivering three-phase AC power from a power source at the surface to a three-phase AC motor located in a well, measuring means for monitoring at the surface at least one physical parameter in the environment of the motor, comprising in combination:

a downhole assembly located in the well in the vicinity of the motor and having a transmitter means for generating a signal and for superimposing the signal onto the power cable;

sensing means in the downhole assembly for providing an electrical response corresponding to at least one physical parameter;

modulating means in the downhole assembly for modulating the signal with the electrical response, and providing a modulated signal on the power cable that corresponds to the physical parameter; and conversion means in a surface unit for converting the modulated signal into a readout signal proportional to the physical parameter.

2. In a pump installation having a power cable for delivering three-phase AC power from a power source at the surface to a three-phase AC motor located in a well, measuring means for monitoring at the surface at least one physical parameter in the environment of the motor, comprising in combination:

a downhole unit located in the well in the vicinity of the motor and having transmitter means for generating a carrier signal of fixed frequency much higher than the frequency of the AC power, and for superimposing the carrier signal onto the power cable;

sensing means in the downhole assembly for providing an electrical response corresponding to at least one physical parameter;

modulating means in the downhole assembly for turning the carrier signal on and off in proportion to the electrical response, providing a modulated signal with pulse envelopes of duration corresponding to the physical parameter; and conversion means in a surface unit for detecting the duration of the envelopes and for providing a readout signal proportional to the physical parameter.

3. In a pump installation having a power cable for delivering three-phase AC power from a power source at the surface to a three-phase AC motor located in a well, measuring means for monitoring at the surface at least two physical parameters in the environment of the motor, comprising in combination:

a downhole assembly located in the well in the vicinity of the motor and having an oscillator means for generating a carrier signal of fixed frequency much higher than the frequency of the AC power;

sensing means in the downhole assembly for providing electrical responses corresponding to at least two physical parameters;

modulating means in the downhole assembly for providing controlling pulses of duration proportional to one of the electrical responses to a switching means for switching the carrier signal into a modulated signal with envelopes of duration proportional to the pulses and to one of the parameters, and with the interval between the pulses having durations proportional to the other of the parameters;

downhole filter means in the downhole assembly for passing the modulated signal onto the power cable and for blocking the AC power in the power cable from the modulating means;

uphole filter means in a surface unit for passing the modulated signal and blocking the AC power in the power cable; and conversion means in the surface unit for detecting the duration of the envelopes and the intervals between the envelopes and for providing readout signals proportional to the physical parameters.

4. In a pump installation having a power cable for delivering three-phase AC power from a power source at the surface to a three-phase AC motor located in a well, measuring means for monitoring at the surface pressure and temperature in the environment of the motor, comprising in combination:

a downhole assembly located in the well in the vicinity of the motor and having a transmitter means for generating a signal and for superimposing the signal onto the power cable;

pressure transducer means in the downhole assembly for providing an electrical response corresponding to pressure in the environment of the motor;

temperature transducer means in the downhole assembly for providing an electrical response corresponding to temperature in the environment of the motor;

modulating means in the downhole assembly for modulating the signal with the electrical responses and for providing a modulated signal on the power cable that corresponds to both the pressure and the temperature;

inductive means for inductively coupling power to the downhole assembly from windings of the motor; and conversion means in a surface unit for converting the modulated signal into a readout signal proportional to the physical parameter.

5. In a pump installation having a power cable for delivering three-phase AC power from a power source at the surface to a three-phase AC motor located in a well, measuring means for monitoring at the surface at least one physical parameter in the environment of the motor, comprising in combination:

a downhole assembly located in the well in the vicinity of the motor and having a transmitter means for generating a signal and for superimposing the signal onto the power cable;

sensing means in the downhole assembly for providing an electrical response corresponding to a physical parameter;

modulating means in the downhole assembly for modulating the signal with the electrical response and for providing a modulated signal on the power cable that corresponds to the physical parameter;

power supply means in the downhole assembly for supplying DC power to the transmitter means, sensing means and modulating means, the power supply means being supplied with AC power through a loop of wire that extends through a stator of the motor and inductively couples AC power from windings in the stator; and conversion means in a surface unit for converting the modulated signal into a readout signal proportional to the physical parameter.

6. In a pump installation having a power cable for delivering three-phase AC power from a power source at the surface to a three-phase AC motor located in the well, measuring means for monitoring at the surface two physical parameters in the environment of the motor, comprising in combination:

a downhole assembly located in the well and in the vicinity of the motor and having an oscillator means for generating a fixed frequency carrier signal of frequency much higher than the frequency of the AC power;

sensing means at the downhole assembly for providing an electrical response proportional to two physical parameters;

modulating means in the downhole assembly for providing controlling pulses to a switching means for switching the carrier signal on and off, the duration of the pulses being proportional to one of the physical parameters, and the interval between the pulses being proportional to the other of the physical parameters;

inductive means for inductively coupling power to the downhole assembly from windings of the motor;

downhole filter means in the downhole assembly for passing the carrier signal onto the power cable and for blocking the AC power in the power cable from the modulating means;

uphole filter means in a surface unit for passing the carrier signal and for blocking the AC power in the power cable; and conversion means in the surface unit for detecting the duration of the pulses and of the intervals between the pulses and for converting the durations and intervals to readout signals proportional to the physical parameters.

7. In a pump installation having a power cable for delivering three-phase AC power from a power source at the surface to a three-phase AC motor located in the well, measuring means for monitoring at the surface pressure and temperature in the environment of the motor, comprising in combination:

a downhole assembly located in the well in the vicinity of the motor and having an oscillator means for generating a fixed frequency carrier signal at a frequency much higher than the frequency of the AC power;

pressure transducer means in the downhole assembly for providing a variable resistance corresponding to pressure in the environment of the motor;

temperature transducer means in the downhole assembly for providing a variable resistance corresponding to temperature in the vicinity of the motor;

capacitor means connected to each of the transducer means for storing and discharging electrical current passing through each of the transducer means;

operational amplifier means connected to the capacitor means for providing a first output when the capacitor means is charging and a second output when the capacitor means is discharging;

directing means in the downhole assembly for directing current through one of the transducer means until the capacitor means charges to a selected level, then directing current through the other of the transducer means until the capacitor means discharges a selected level;

switching means for passing the carrier signal onto the power cable when the operational amplifier means provides one of the outputs, and for blocking the carrier signal from the power cable when the operational amplifier means provides the other of the outputs, providing a modulated signal that corresponds to the temperature and pressure in the environment of the motor; and conversion means in a surface unit for converting the modulated signal into a readout signal proportional to temperature and pressure.

* * * * *